US005186409A

United States Patent [19]

Kansaku

[11] Patent Number: 5,186,409

[45] Date of Patent: Feb. 16, 1993

[54] TENSION CONTROL DEVICE FOR PRINTING PAPER

[75] Inventor: Toshio Kansaku, Sagamihara, Japan

[73] Assignee: Kabushikigaisha Tokyo Kikai Seisakusho, Tokyo, Japan

[21] Appl. No.: 512,110

[22] Filed: Apr. 20, 1990

[30] Foreign Application Priority Data

May 12, 1989 [JP] Japan ..... 1-119958

[51] Int. Cl.[5] ..... B65H 23/10

[52] U.S. Cl. ..... 242/75.44; 242/75; 242/75.4

[58] Field of Search ..... 242/75, 75.4, 75.43, 242/75.44, 75.53; 226/44

[56] References Cited

U.S. PATENT DOCUMENTS

| | | | |
|---|---|---|---|
| 2,343,181 | 2/1944 | Heinz | 242/75.43 |
| 2,922,594 | 1/1960 | Pawlowski | 242/75.53 |
| 2,988,297 | 6/1961 | Pawlowski | 242/75.53 |
| 3,289,967 | 12/1966 | Robinson | 242/75.43 |
| 3,853,282 | 12/1974 | Wentworth | 242/75.44 |
| 3,913,855 | 10/1975 | Heimlicher et al. | 242/75.43 |
| 4,000,865 | 1/1977 | Gaskins | 242/75.53 X |
| 4,151,594 | 4/1979 | Stern | 242/75.44 X |
| 4,245,793 | 1/1981 | Stewart | 242/75.43 |
| 4,359,178 | 11/1982 | Hayashi et al. | 226/44 X |
| 4,903,909 | 2/1990 | Suzuki | 242/75.44 X |

FOREIGN PATENT DOCUMENTS

| | | | |
|---|---|---|---|
| 560087 | 7/1958 | Canada | 226/44 |
| 55-93756 | 7/1980 | Japan . | |
| 1210166 | 10/1970 | United Kingdom | 242/75 |

*Primary Examiner*—Katherine Matecki
*Assistant Examiner*—John P. Darling
*Attorney, Agent, or Firm*—Foley & Lardner

[57] ABSTRACT

A tension control device is capable of controlling the tension applied to a printing paper after a paper setting work in a printing apparatus. The tension control device comprises a paper feeding means equipped with a braking unit capable of braking paper feeding motion of a rolled paper supported on the paper feeding means, a tension detecting means for detecting the tension applied to the printing paper, a virtual tension applying means for applying a virtual tension to the tension detecting means, and a braking force control means for controlling the braking force of the braking unit in the paper feeding means in linkage with the tension detecting means. This tension control device ensures automatic tensioning after the paper setting operation without tearing the paper.

5 Claims, 5 Drawing Sheets

TENSION CONTROL DEVICE FOR PRINTING PAPER

BACKGROUND OF THE INVENTION

1. Field of the Invention

The present invention generally relates to tension control device for a printing paper. More particularly, the present invention relates to an improvement in tension control system for exactly applying tension to an printing paper with ease and accuracy immediately after a initial feeding step is performed in a rotary press.

2. Description of the Prior Art

Since printing paper should be always applied with a stable tension during the printing operation, various tension control and applying devices have been provided. One conventional device is disclosed by Japanese Patent Application Laid-Open Publication No. 55-93756, provided by the same applicant of this invention, entitled "Automatic Tension Control Device for Running Paper at Emergency Stop of Rotary Press". This conventional device is shown in FIG. 5 of the attached drawings of this specification. This drawing corresponds to FIG. 1 in the original publication document. In FIG. 5, a three pronged arms member 1 is pivotably supported on a pivot 2. One end of the three pronged arms member 1 bearing a braking mechanism 3 supports a rolled paper 6 which is rotatably set on a supporting member, not shown, mechanically connected to the braking mechanism 3. Printing paper 7 is drawn from the rolled paper 6 and passed through guide rollers 8 and 8*a*, a floating roller 9 and a guide roller 8*b*, and finally introduced into a printing section. The floating roller 9 is pivotably supported on a free end of a swing arm 11, the other end of which is pivotably supported on a pivot 10. The central point of the swing arm 11 is connected to a rod 12*a* of a pneumatic cylinder 12. The rod 12*a* supports the swing arm 11, which is subjected to the tension force applied to the printing paper 7, through the floating roller 9. The rod 12*a* is pressed by pneumatic pressure controlled by a regulator 15, so that the rod 12*a* can hold the swing arm 11 in a constant position. The pneumatic pressure value Y determined by the regulator 15 corresponds to a tension setting value for the printing paper 7.

When the printing paper 7 is loosened, the swing arm 11 is rotated in the clockwise direction in the drawing. A cam 17 at the pivot side end of the swing arm 11 also rotates and actuates a pressure control valve 16. Predetermined pneumatic pressure is fed from the pressure control valve 16 to the braking mechanism 3 to increase the braking force of the mechanism 3. Thus, the braking mechanism 3 can fixingly hold the rolled paper 6 to prevent the printing paper 7 from drawing.

On the other hand, when the printing paper 7 is stretched with a greater force than a predetermined value, the swing arm 11 is rotated in the counter-clockwise direction in the drawing. According to this motion, the braking force of the braking mechanism 3 is decreased so that the printing paper 7 can be easily drawn from the rolled paper 6.

In such automatic manner the conventional device can always apply a stable tension onto the printing paper 7.

However, the above described conventional device has the following drawbacks in its printing paper feed operation conducted at the first step in printing operation.

The printing paper should be slightly loosened during the paper initial feeding operation because the printing paper cannot be wholly applied with a uniform tension over its width. In the conventional device, the swing arm 11 will rotate in the clockwise direction and increase the braking force of the braking mechanism 3. Therefore, the pneumatic pressure should be released from the braking mechanism 3 in order to draw the printing paper 7 from the rolled paper 6. This requires an additional operation comprising the manual switching of a valve 33 which is switched into an OFF position to release remaining pneumatic pressure from the braking mechanism 3.

After initially feeding the printing paper from the printing section to a paper folding section, another valve 31 is opened and the manual switching valve 33 is switched into an ON position. Successively, the valve 31 is gradually closed and the printing system is driven at a slow speed. This operation gradually increases the braking force of the braking mechanism 3 and starts to run the printing paper 7. Accordingly, the printing paper 7 is gradually applied with tension up to a predetermined value to perform a normal printing work.

The above described series of operations for feeding printing paper 7 and adjusting the tension thereof require the operator to take notice of the condition of the printing paper 7. Further these operations demand complicated and manual operations that need a skilled operator. Therefore, this problem causes various disadvantages such as low working efficiency, high costs, poor product quality, and so on.

BRIEF DESCRIPTION OF THE INVENTION

It is an object of the present invention to provide a tension control device for applying tension to a printing paper with ease and accuracy immediately after an initial feeding step operation in a rotary press.

To accomplish the above object, the tension control device according to the present invention comprises a paper feeding means equipped with a braking unit capable of braking paper feeding motion of a rolled paper supported on the paper feeding means, a tension detecting means for detecting the tension applied to the printing paper, a predetermined tension applying means for applying a predetermined tension to the tension detecting means, and a braking force control means for controlling the braking force of the braking unit in the paper feeding means in cooperation with the tension detecting means.

In the tension control device according to the present invention, as the tension detecting means is applied with the predetermined tension from the predetermined tension applying means, the braking force control means in linkage with the tension detecting means makes the braking unit of the paper feeding means release its braking force. Thus, the paper can be freely drawn from the paper feeding means to transfer the paper. After the paper has been fed, the printing paper is immediately run and the predetermined force applying means gradually releases the predetermined force applied to the tension detecting means. Thus the printing paper is gradually applied with a stable tension adapted for the printing operation in an automatic manner.

The above and other related objects and features of the invention will be apparent from a reading of the following description of the disclosure found in the accompanying drawings :nd the novelty thereof pointed out in the appended claims.

BRIEF DESCRIPTION OF THE DRAWINGS

FIG. 1 to FIG. 4 are drawings illustrating the construction and operation of the preferred embodiment of the present invention; wherein, FIG. 1 is a simplified diagram showing the whole pneumatic circuit of the tension control device according to the present invention;

FIG. 2, 3 and 4 are similar diagrams to FIG. 1 for explaining a series of paper feeding and tension controlling operations.

DETAILED DESCRIPTION OF THE PREFERRED EMBODIMENT

One preferred embodiment related to the present invention will be described in conjunction with the drawings FIGS. 1 to 4.

In this embodiment, the tension control device comprises a paper feeding means A, a tension detecting means B, a virtual tension applying means C, and a braking force control means D. Tension detecting means B detects as well as applies tension to the printing paper.

Figure 1:
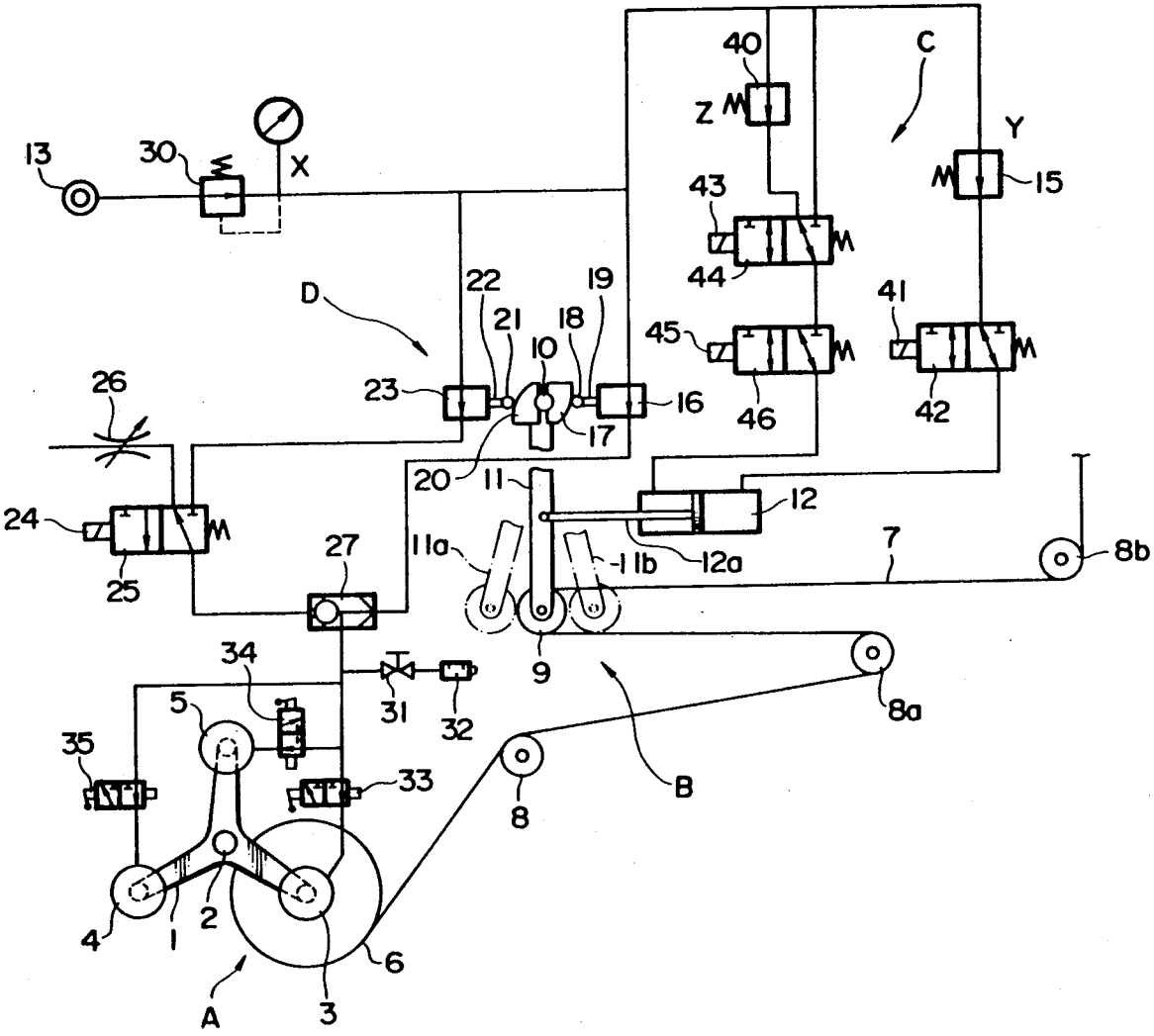

As shown in FIG. 1, the paper feeding means A includes a three pronged arms member 1 and a braking mechanism 3 which is assembled on one of the arms. A rolled paper 6 is set on the arm bearing the braking mechanism 3. A printing paper 7 is fed from the rolled paper 6 under the control of the braking mechanism 3.

The tension detecting means B includes a swing arm 11, one end of which is swingingly supported on a pivot 10, a floating roller 9 pivotally supported on a free end of the swing arm 11, and a pneumatic cylinder 12 connected to the swing arm 11 through a cylinder rod 12*a* of the pneumatic cylinder 12. The rod 12*a* is always urged by the pneumatic cylinder 12 to support the swing arm 11, which is subjected to the tension force applied to the printing paper 7, through the floating roller 9.

The braking force control means D includes a first pneumatic circuit connecting a pneumatic power source 13 to the braking mechanism 3. The first circuit mainly contains first and second pressure control valves 16 and 23 which are respectively actuated by the swing arm 11 through cams 17 and 20.

The tension applying means or positioning C includes a second pneumatic circuit which mainly contains a plurality of electromagnetic valves 42, 44, and 46 and two regulators 15 and 40 which switch the urging direction of the cylinder rod 12*a*. The term "predetermined force" means a force of predetermined magnitude applied to the tension detecting means B by the tension applying means C. A predetermined force is applied to the tension detecting means B via tension applying means C by switching the urging direction of the cylinder rod 12*a*. Numerals 41, 43 and 45 denote solenoids which switch the electromagnetic valves 42, 44 and 46 between their open and closed positions, respectively.

Further, numerals 30, 15 and 40 denote regulators arranged in the first and second pneumatic circuits. The preset pressure values cf the regulators 30, 15 and 40 are respectively represented by X, Y and Z. As shown in FIG. 1, the regulator 30 is arranged heard the pneumatic power source 13. The regulators 15 and 40 are arranged in the second pneumatic circuit downstream of the regulator 30. The regulator 15 is disposed upstream of the electromagnetic valve 42. The regulator 40 is disposed upstream of the electromagnetic valve 44. The preset pressure values X, Y and Z are defined by the relation; $X>Y>Z$. Further, a pressure difference Q given by the formula $Y-Z=Q$ is controlled to be smaller than a certain value that may cause the printing paper to tear when the floating roller 9 presses the printing paper 7.

In FIG. 1, the other components such as other braking mechanisms 4 and 5 are not described in detail because their mechanisms and functions are essentially same the as the mechanism 3. Further, other assistant elements such as a shuttle valve 27 etc. are also not described because they are not directly related to explain the present invention.

In order to fully understand the tension control device according to the present invention, a typical operation for performing the paper tension setting and control operations will be described hereafter.

Referring to FIG. 1, the pneumatic power source 13 is switched on to start feeding pneumatic pressure into the first and second pneumatic circuits. The pressure values X, Y and Z for the regulators 30, 15 and 40 have been previously set to the relation 15 and 40 have. The pneumatic pressure X regulated by the regulator 30 is partially fed to the paper feeding means A through the braking force control means D and its remaining pressure is also fed to the tension applying means C.

In the tension applying means C, the pneumatic pressure Y regulated by the regulator 15 is fed to the right chamber of the pneumatic cylinder 12 to urge the rod 12*a* towards the left in the drawing through the electromagnetic valve 42. The pneumatic pressure Z regulated by the regulator 40 is fed to the left chamber of the pneumatic cylinder 12 to urge the rod 12*a* towards the right in the drawing through the electromagnetic valves 44 and 46. The pneumatic pressure partially fed from the regulator 30 is also collectively introduced to the left chamber of the pneumatic cylinder 12 through the electromagnetic valves 44 and 46. The electromagnetic valve 44 alternatively switches one pneumatic passage to feed the pneumatic pressure Z to the left chamber of the pneumatic cylinder 12 and the other pneumatic passage to feed the pneumatic pressure X to the left chamber.

In order to facilitate the initial feeding of the printing paper 7 and to apply softly the tension onto the printing paper 7 after initial feeding, the pneumatic pressures X, Y and Z are independently fed to the pneumatic cylinder 12 through the electromagnetic valves 42, 44 and 46 by a sequential control operation.

This sequential control operation will be described in detail with reference to FIGS. 2 to 4.

Figure 2:
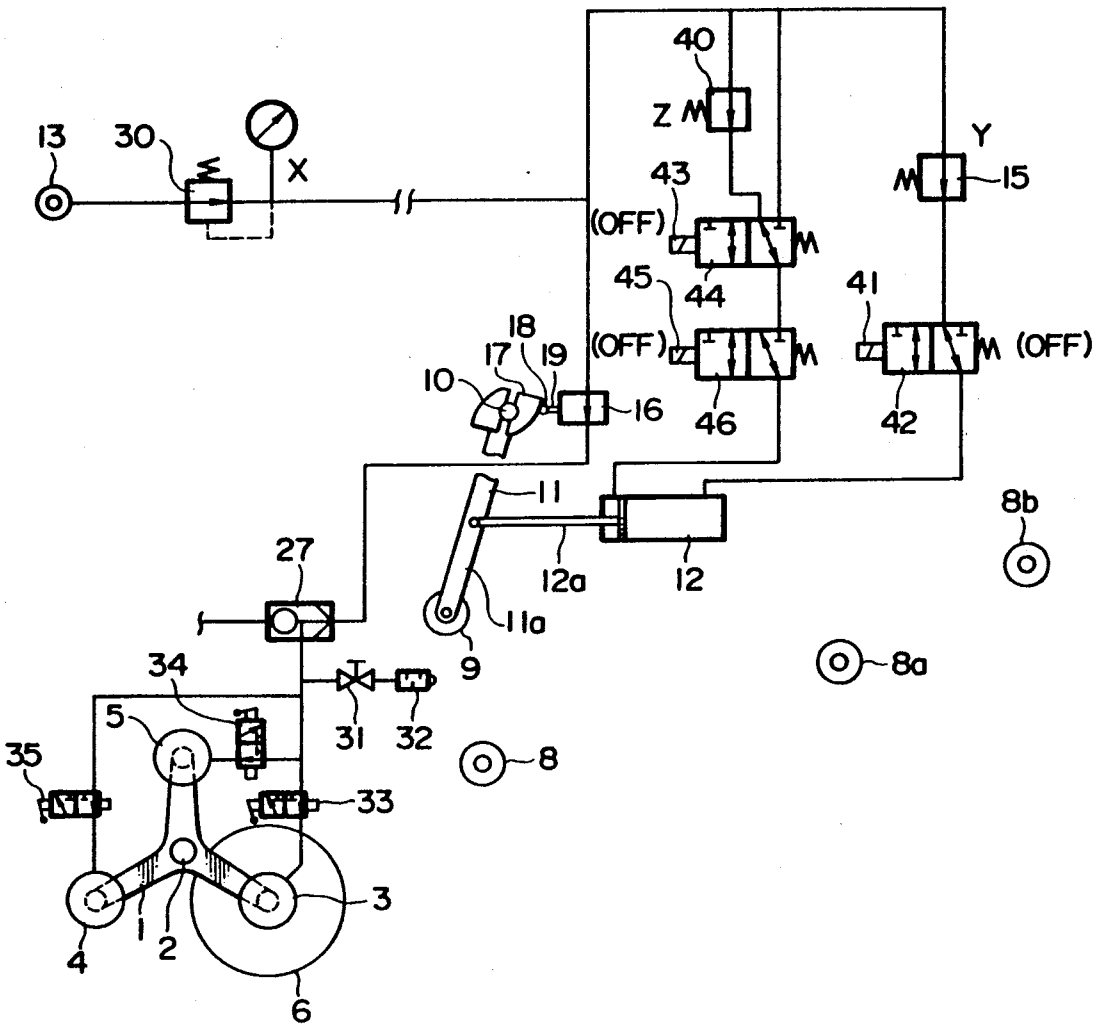
Figure 3:
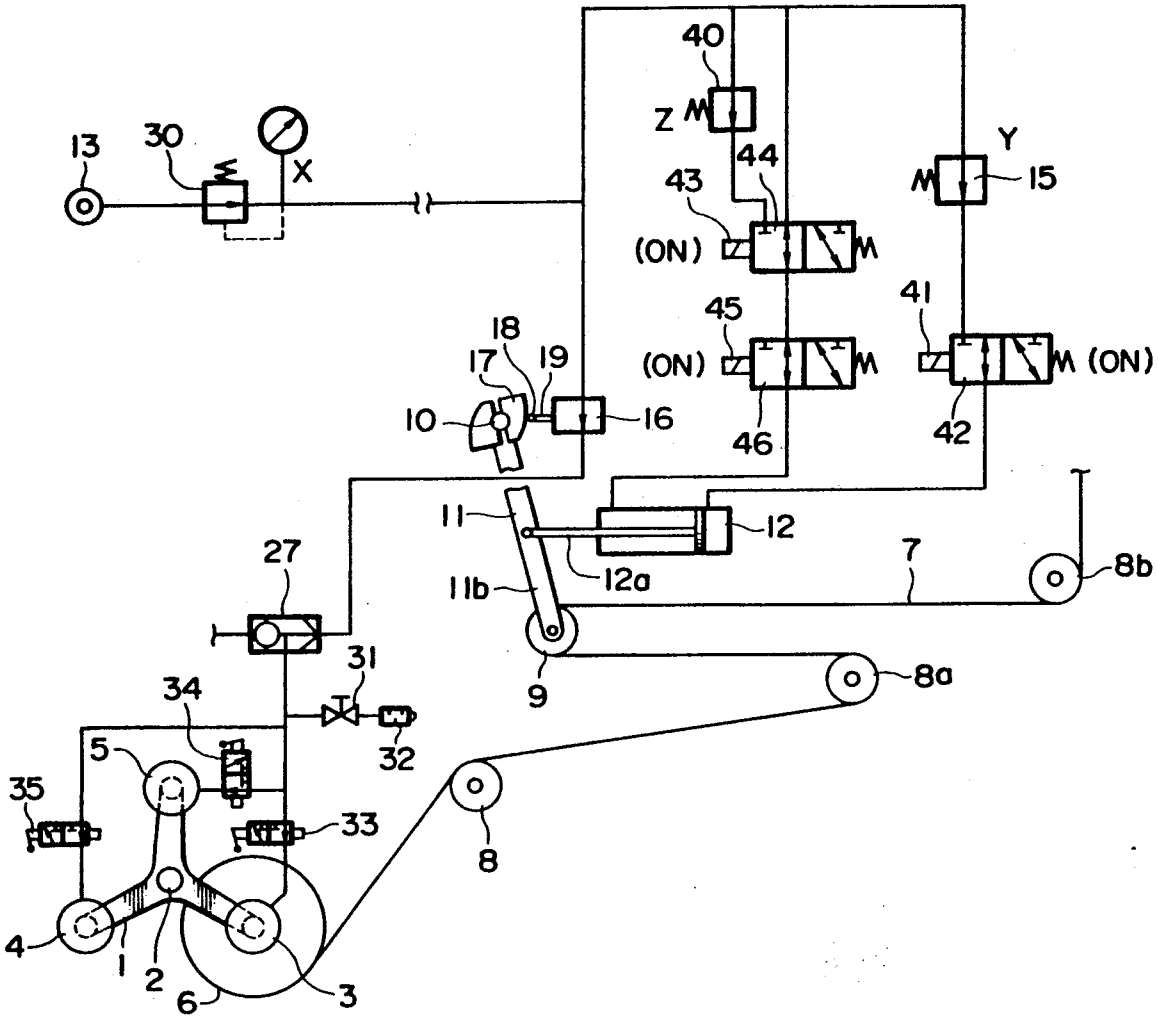

Firstly, the solenoids 41, 43 and 45 are not energized as shown in FIG. 2. Under this condition, the pneumatic pressure from the source 13 introduced into the right chamber of the pneumatic cylinder 12 through the regulator 15. Thus the rod 12*a* is urged leftwardly to the most extended position so that the swinging arm 11 is rotated in the clockwise direction up to the position 11*a* restricted by a stopper, not shown. The first pressure control valve is simultaneously opened in response to the rotation of the cam 17 which rotates with the swinging arm 11. The braking force of the braking mechanism 3 in the paper feeding means A is therefore increased.

Prior to the initial feeding operation, the braking force of the braking mechanism 3 should be decreased and the printing paper 7 should be drawn from the rolled paper 6. Secondly, all switches for the solenoids 41, 43 and 45 are turned on to energize them as shown in FIG. 3, so that pneumatic pressure fed from the power source 13 is only introduced into the left chamber of the pneumatic cylinder 12 to urge the rod 12*a* rightwardly. The swinging arm 11 is rotated in the counter-clockwise direction up to the position 11*b* restricted by another stopper, not shown. The first pressure control valve 16 is simultaneously closed in response to the rotation of the cam 17 which rotates with the swinging arm 11. The braking force of the braking mechanism 3 in the paper feeding means A is therefore decreased. Under this condition, the printing paper 7 is drawn from the rolled paper and set on the first and second guide rollers 8 and 8*a*, the floating roller 9, and a third guide roller 8*b*. Subsequently, the printing paper 7 is introduced to a printing section of the printing apparatus, not shown, and a folding section, not shown.

Under this condition, if the solenoids 41, 43 and 45 are turned off, the pneumatic pressure feeding circuits will be immediately switched into the state shown in FIG. 2; that is, the remaining air in the left chamber of the pneumatic cylinder 12 is released to its the ambient air, the pneumatic pressure passed through the regulator 15 is only fed into the right chamber of the pneumatic cylinder 12. The rod 12*a* is urged leftwardly by the pneumatic pressure Y, and thus the floating roller 9 suddenly stretches the printing paper 7. Accordingly, the printing paper 7 is easily torn.

In order to avoid this problem, the following tension applying operation will be conducted.

Figure 4:
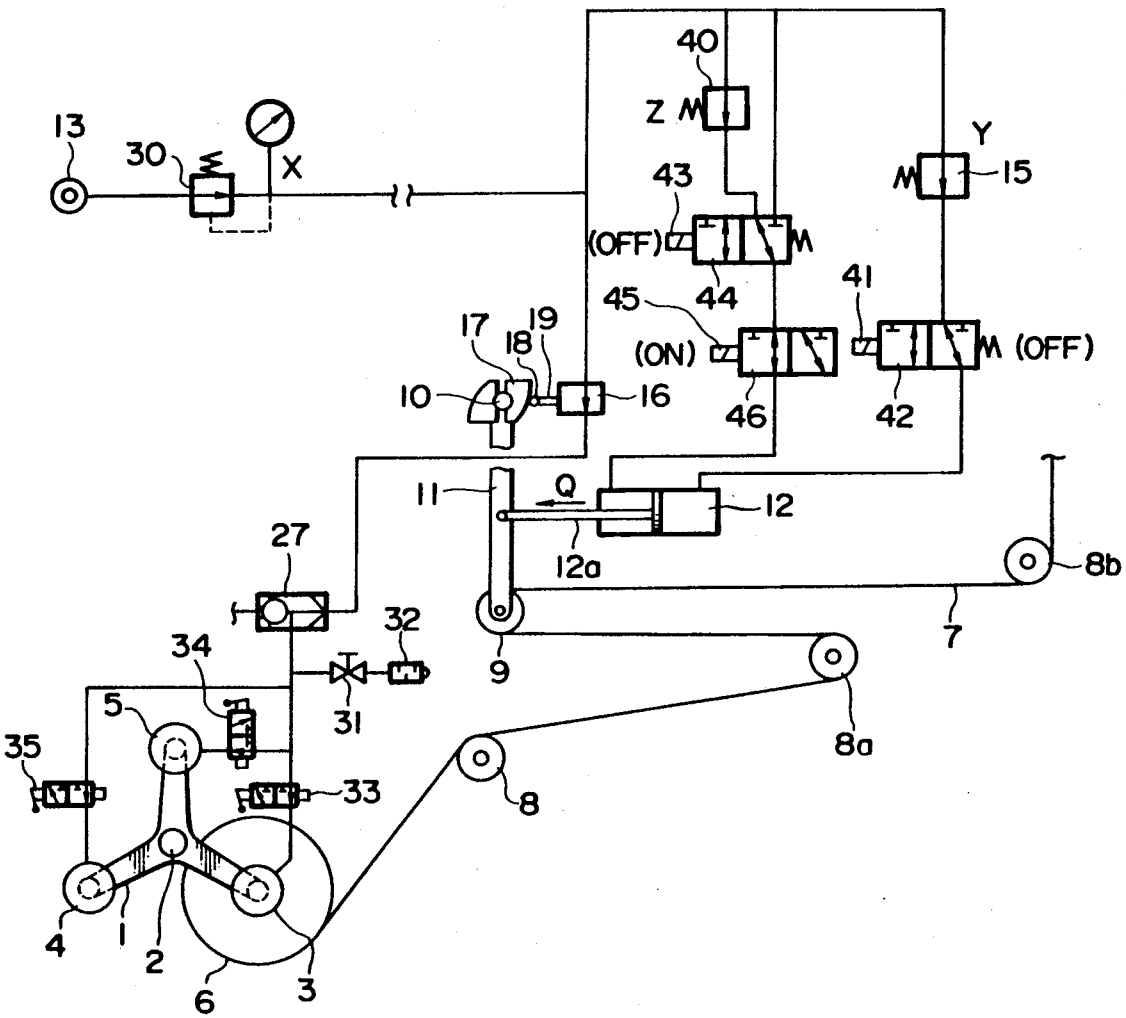
Figure 5:
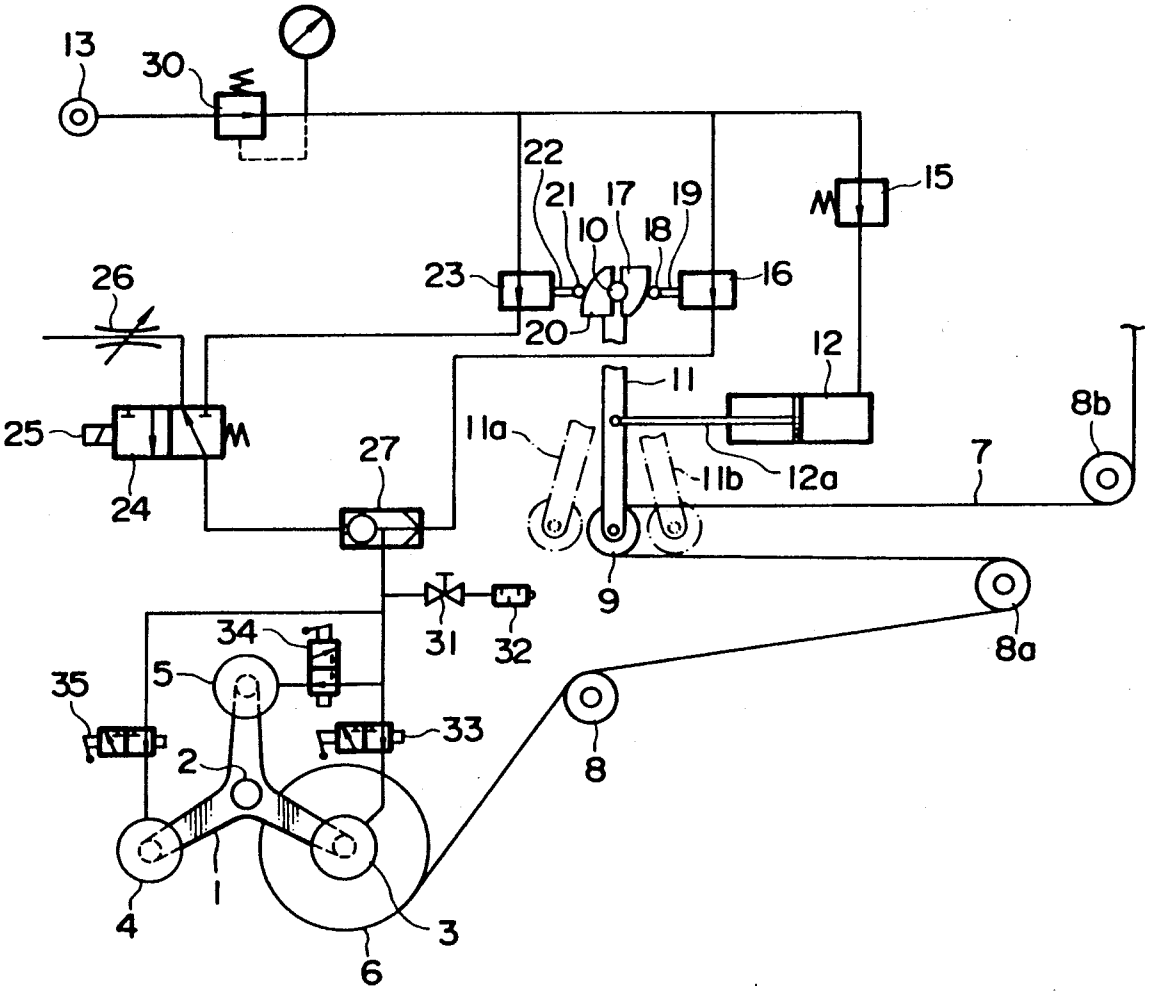
FIG. 5 PRIOR ART
FIG. 5 is a diagram showing a pneumatic circuit of a conventional tension control device.

Firstly, the solenoids 41 and 43 are turned off as shown in FIG. 4. Then the right chamber of the pneumatic cylinder 12 is supplied with the pneumatic pressure value Y from the regulator 15 and the left chamber thereof is also supplied with the pneumatic pressure value Z from the regulator 40. The pneumatic pressure values Y and Z have been previously set that the value Y is greater than the value Z and the difference therebetween $Y-Z=Q$ is predetermined to be smaller than a certain value that may cause the printing paper to tear when the floating roller 9 is pressed on the printing paper 7. Therefore, the rod 12*a* is moved leftwardly by the predetermined pressure difference Q. The predetermined pressure difference Q is so determined as to move slowly the rod 12 for applying a predetermined tension onto the printing paper 7 without tearing and for keeping the balance between the tension applied to the printing paper 7 and the swinging motion of the swing arm 11. Under this balanced condition, the swing arm 11 and the floating roller 9 are kept in that position.

Even when the printing paper 7 is suddenly subjected to stretching forces at the beginning of a paper-running operation, the stretching force will be absorbed to some degree by the pneumatic cylinder 12 as a shock-absorber.

Under this condition, the printing paper 7 is fed for a while with the operation of the main apparatus. The printing paper 7 is applied with the optimum tension caused by the swing arm 11 urged by the predetermined force created by predetermined pneumatic pressure Q and the friction of the floating roller 9, so that the printing paper 7 can be free from loosening. After that, the solenoid 45 is turned off to intercept the pneumatic pressure Z from the regulator 40 and release the remaining pressure in the left chamber of the pneumatic cylinder 12 to the ambient air through the electromagnetic valve 46. Thus the rod 12*a* is urged leftwards by the pneumatic pressure Y and the swing arm 11 is rotated to the left side position as shown in FIG. 2.

This operation does not require the termination of the paper feeding operation to apply tension onto the paper 7, and can apply the tension adapted for a stable printing operation. After setting the tension, the printing paper 7 is automatically applied with the optimum tension for its printing condition.

In the drawings, the braking force control mechanism 3 is controlled by the second pressure control valve 23 which is actuated in response to the rotation of the cam 20. This braking force control system will effectively act to stop the printing apparatus in case of emergency. This system has been already known and practically used in may printing devices, so that the detailed description on this system is omitted.

As explained above, the sequential operation of performing the tension control only requres the switching of the solenoids 41, 43 and 45 without any troublesome procedure for the operator, and can be performed in an automatic way. Accordingly, the control device employing this control operation can ensure the performance of the tension applying operation after the paper setting operation with ease, accuracy, without tearing the printing paper, and in simple manner without requiring skilled operations. Particularly, this tension control operation can be automatically performed, thereby eliminating operator error and complicated procedures the operator. In addition to the above effects, this tension control device will simplify the operation and reduce the number of nam operators.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A device comprising:

(A) paper feeding means for feeding paper from a roll supported thereon;

(B) a braking unit which is connected to said paper feeding means and which brakes a feeding motion of said paper feeding means;

(C) tension force detecting and applying means for detecting a tension force applied to said printing paper and for imposing a tension force on said printing paper;

(D) braking force control means, connected to said tension force detecting and applying means, for controlling said braking unit to vary the braking force imposed on said paper feeding means in dependence on the tension force detected by said tension force detecting and applying means; and (E) force applying means for imposing a force on said tension force detecting and applying means in addition to a tension force imposed on said tension force detecting and applying means by said printing paper, said force applying means comprising (i) pressure regulators which apply opposing pressures on said tension force detecting and applying means to impose a net force on said force detecting and applying means resulting from the difference between said opposing pressures, (ii) means for controlling said pressure regulators to apply opposing pressures to said tension force detecting and applying means to produce a first predetermined net pressure which imposes a first predetermined force on said tension force detecting and applying means during a an initial paper feeding operation, and (iii) means for controlling said pressure regulators to apply opposing pressures to said tension force detecting and applying means to produce a second predetermined net pressure which imposes a second predetermined force on said tension force detecting and applying means during a paper feeding operation taking place following said initial paper feeding operation, said second predetermined force being lower than said first predetermined force;

wherein said tension force detecting and applying means comprises a swing arm and a stationary cylinder having a movable cylinder rod which is connected to said swing arm, and wherein said force applying means drives said cylinder rod within said cylinder to vary the distance between said swing arm and said cylinder;

wherein said cylinder further comprises a piston which is slidable therein and which is attached to said cylinder rod, and wherein said force applying means comprises fluid circuits which apply fluid pressure to opposite sides of said piston;

wherein said force applying means further comprises a source of fluid pressure, first, second, and third lines which are connected to said source, said pressure regulators comprising first, second, and third pressure regulators located in said first, second, and third lines, respectively, each of said pressure regulators regulating the pressure of fluid within the respective line to respective first, second, and third pressure levels, a first valve selectively supplying fluid from said first pressure regulator to one side of said piston, a second valve selectively supplying fluid from said second regulator to said one side of said piston, and a third valve selectively supplying fluid from said third pressure regulator to the side of said piston opposite said first side.

2. A tension control device according to claim 1, wherein the position of said tension force detecting and applying means is variable with the force imposed thereon by said printing paper and said force applying means, and wherein said braking force control means varies the braking force imposed on said paper feeding means in dependence on the position of said tension force detecting and applying means.

3. A tension control device according to claim 1, wherein said force applying means further comprises means for imposing a third predetermined force on said tension force detecting and applying means prior to said initial paper feeding operation which is lower than said second predetermined force.

4. A device comprising:

(A) a paper feeding device;

(B) a braking unit which is connected to said paper feeding device and which brakes a feeding motion of said paper feeding device;

(C) a tension force detecting and applying device which detects a tension force applied to said printing paper, said tension force detecting and applying device imposing a tension force on said printing paper, said tension force detecting and applying device comprising a stationary cylinder, a piston slidable within said cylinder, and a cylinder rod connecting said piston to a device which contacts said printing paper;

(D) a braking force control device which is connected to said tension force detecting and applying device and which controls the braking force of said braking unit in dependence on the tension force detected by said tension force detecting and applying device; and (E) a force applying device which is connected to said tension force detecting and applying device, said force applying device comprising a fluid circuit selectively supplying fluid pressure to first and second opposed sides of said piston, said fluid circuit including valves which are selectively actuatable (i) to supply a first predetermined net pressure to said piston to impose a first predetermined force on said tension force detecting and applying device during an initial printing paper feeding operation, and (ii) to supply a second predetermined net pressure to said piston to impose a second predetermined force on said tension force detecting and applying device during a paper feeding operation taking place following said initial printing paper feeding operation, said second predetermined pressure being lower than said first predetermined pressure within said first fluid circuit further comprises a source of fluid pressure first, second, and third pressure regulators located in respective lines connected to said source of fluid pressure, each of said pressure regulators regulating the pressure of fluid within the respective line to respective first, second, and third pressure levels, and wherein said valves include a first valve selectively supplying fluid from said first pressure regulator to said first side of said piston, a second valve selectively supplying fluid from said second regulator to said first side of said piston, and a third valve selectively supplying fluid from said third pressure regulator to said second side of said piston.

5. The tension control device according to claim 4, wherein said tension force detecting and applying device comprises a pivot, a swing arm which is pivotally supported on said pivot at a first end and which is connected to said cylinder rod, and a floating roller pivotally supported on a second end of said swing arm.

* * * * *